United States Patent [19]

Marcotte et al.

[11] 4,389,980

[45] Jun. 28, 1983

[54] BOILER FOR USE WITH CHARGES OF WOOD FUEL

[75] Inventors: Richard P. Marcotte; John W. Dumont, Jr., both of Monmouth, Me.

[73] Assignee: Dumont Industries, Monmouth, Me.

[21] Appl. No.: 199,333

[22] Filed: Oct. 21, 1980

Related U.S. Application Data

[63] Continuation-in-part of Ser. No. 114,227, Jan. 22, 1980, abandoned.

[51] Int. Cl.[3] ..... F22B 9/02

[52] U.S. Cl. ..... 122/114; 122/123; 122/20 B; 122/421; 237/56; 126/112

[58] Field of Search ..... 122/114, 421, 123, 20 B, 122/DIG. 1, 15, 17; 237/8 R, 56, 55; 126/367, 312, 112, 111; 165/DIG. 2; 110/336

[56] References Cited

U.S. PATENT DOCUMENTS

| | | | |
|---|---|---|---|
| 1,553,652 | 9/1925 | Vrba | 110/336 |
| 1,700,411 | 1/1929 | King | 122/20 B |
| 1,859,745 | 5/1932 | Morley | 122/17 |
| 2,222,893 | 11/1940 | Allemann | 126/112 |
| 2,561,461 | 6/1951 | Coleman, Jr. | 110/336 |
| 2,578,927 | 12/1951 | Esson | 126/111 |
| 4,292,933 | 10/1981 | Meier et al. | 122/20 B |
| 4,309,965 | 1/1982 | Hill | 122/15 |

FOREIGN PATENT DOCUMENTS

| | | | |
|---|---|---|---|
| 162070 | 10/1903 | Fed. Rep. of Germany | 126/312 |
| 2303245 | 11/1976 | France | 126/132 |

*Primary Examiner*—Albert J. Makay
*Assistant Examiner*—Henry Bennett

[57] ABSTRACT

A boiler has a chamber to contain a charge of wood that rests on the bottom of the chamber with the major portion of the charge within a water jacketed upper portion of the chamber but free to settle as combustion progresses. Combustion is confined to the bottom portion of the chamber due to the cooling effect of the water jacket and to a turbulent cross draft in the combustion zone. A special venturi section in the flue coupled with a pressure blower both induces the flow of hot gases from the combustion zone through a second chamber and a heat exchanger and also provides a stream of air from the venturi section to create the cross draft. An oil burner may be used in conjunction with the second chamber as an alternate heat source. The boiler also has a special base construction and assembly features.

17 Claims, 11 Drawing Figures

5
5
10
11
12
13
14
15
16
17
18
19
20
21
22
23
24
24
25
26
27
28
29
30
32
33
34
34
37
38
39
40
41
42
43
44
46
46A
49
49
49
50
51
52
52
53
53
54
56
57
58
59
60
61
62
63
65
66
67

BOILER FOR USE WITH CHARGES OF WOOD FUEL

The present application is a continuation-in-part on Ser No. 114,227, filed Jan. 22, 1980, now abandon.

RELATED APPLICATION

The application of Richard C. Hill entitled "Vertical Feed Stick Wood Fuel Burning Furnace System" Filed Sept. 14, 1979, Ser. No. 075,815.

BACKGROUND REFERENCE

U.S. Pat. No. 3,152,839.

BACKGROUND OF THE INVENTION

The above referred to application of Richard C. Hill discloses a boiler having a vertical chamber the upper and major portion of which is a water jacket and the lower portion of which is the combustion zone for a charge of wood resting on the bottom of the chamber with the major portion of the charge within the upper chamber portion but free to settle as combustion progresses.

Combustion is confined to the lower portion of the chamber because of the cooling effect on the wood charge provided but the water jacket and because of a cross draft in the combustion zone. Flow of hot gases from the combustion zone through a tunnel to and through a heat exchanger is induced by a fan coupled to the flue and the turbulent cross draft is derived from a blower.

THE PRESENT INVENTION

A boiler in accordance with the teachings of the above referred to application and as thus summarized opens the way for the efficient use of wood as a fuel for hot water heating systems and the general objective of the present invention is to so improve the boilers as to enable their potentials to be more fully realized.

This objective is attained in accordance with one aspect of the invention by providing a more positive control of the relation between the turbulent cross draft in the combustion zone and the induced flow through the heat exchanger. For that purpose, the flue is provided with a venturi section having a pressure chamber to which a pressure blower is coupled and through which a short, heat exchanger flue section extends with its free end defining with the throat of the venturi an annular orifice. The pressure chamber has a conduit, provided with a shut off, extending into the combustion zone of the chamber and there ported to provide the turbulent cross draft with the pressure and volume of the air stream through the conduit determined by the relationship between the dimensions of the annular venturi orifice and the dimensions of the port or ports that create the jet or jets creating the cross draft. The dimensions of the conduit ensure an appropriate velocity for the jet-creating air stream.

Another objective of the invention is to enable the cover of the fuel receiving chamber to be opened without interrupting the operation of the venturi, an objective attained by providing the conduit by which the cross draft is created in the combustion zone with a shut off in the form of a manually operable damper exposed between the pressure chamber of the venturi and the fuel receiving chamber.

It is preferred, however, that the flow of air through the ports creating the turbulent cross draft be automatically shut off whenever the cover is opened, an objective attained by providing a shut off in the form of a valve connected to a rod extending upwardly through an elbow or tee in the air conduit and through a bushing with a compression spring held captive between the bushing and a contact held by the cover, when closed, against moving upwardly from a first position in which the jet ports are blocked by the valve. When the cover is raised, the spring is operative to so raise the rod that the valve blocks flow through the jet ports. A preferred construction utilizes a heat shield within which the spring is located with a bleeder air passage from the conduit providing a stream of relatively cool air into the heat shield to maintain a temperature about the spring such that no special spring is required to withstand the heat.

Another objective of the invention is to provide a boiler that meets both construction and use requirements, an objective attained with the base having a metal pan in support of high temperature insulation covered with fire brick. The lower portion of the chamber rests on the underlying fire brick and consists of a series of vertical, interlocking molded members of refractory material held together under compression by a metal band. The water jacket rests on the lower portion and is connected to the metal pan by tensioning bolts to unify the components of the chamber. In a preferred base construction, the fire bricks are not bonded together and those forming the chamber bottom are of the hard brick type and the high temperature insulation affords a cushion against localized impacts thereon.

The boiler includes a second chamber formed in part by a cast tunnel resting on the base in communication with the first named chamber and in part by walls of fire brick. The heat exchanger rests on the second chamber and is connected to the pan by tensioning bolts to secure the assembly and the second chamber is dimensioned to ensure that the hot gas stream spreads therein before entering the heat exchanger.

Another objective of the invention is to enable an oil burner to be used as an alternate heat source. To that end, it is provided that an oil burner can have its barrel entrant of the second chamber. In order to ensure efficient use of an oil burner, circuitry is employed that prevents, while the oil burner is in use, the operation of the means by which the cross draft in the combustion zone of the first chamber is created.

Yet another objective is to ensure maximum efficiency in the transfer of heat to a second fluid, typically but not necessarily water, an objective attained with a heat exchanger provided with a series of vertically spaced, flat compartments interconnected within a shroud so that water flows by convection through each from end-to-end and with each of a surface area greater than the inside cross sectional dimensions of the second chamber and with the compartments arranged in the shroud so as to compel the hot gases to flow lengthwise of both surfaces of each compartment, both surfaces having a series of closely spaced fins extending lengthwise thereof.

Other objectives of the present invention and other of its features and advantages will be apparent from the following specification and the appended claims.

BRIEF DESCRIPTION OF THE DRAWINGS

The accompanying drawings illustrate preferred embodiments of the invention of which

THE PREFERRED EMBODIMENTS OF THE INVENTION

Figure 1:
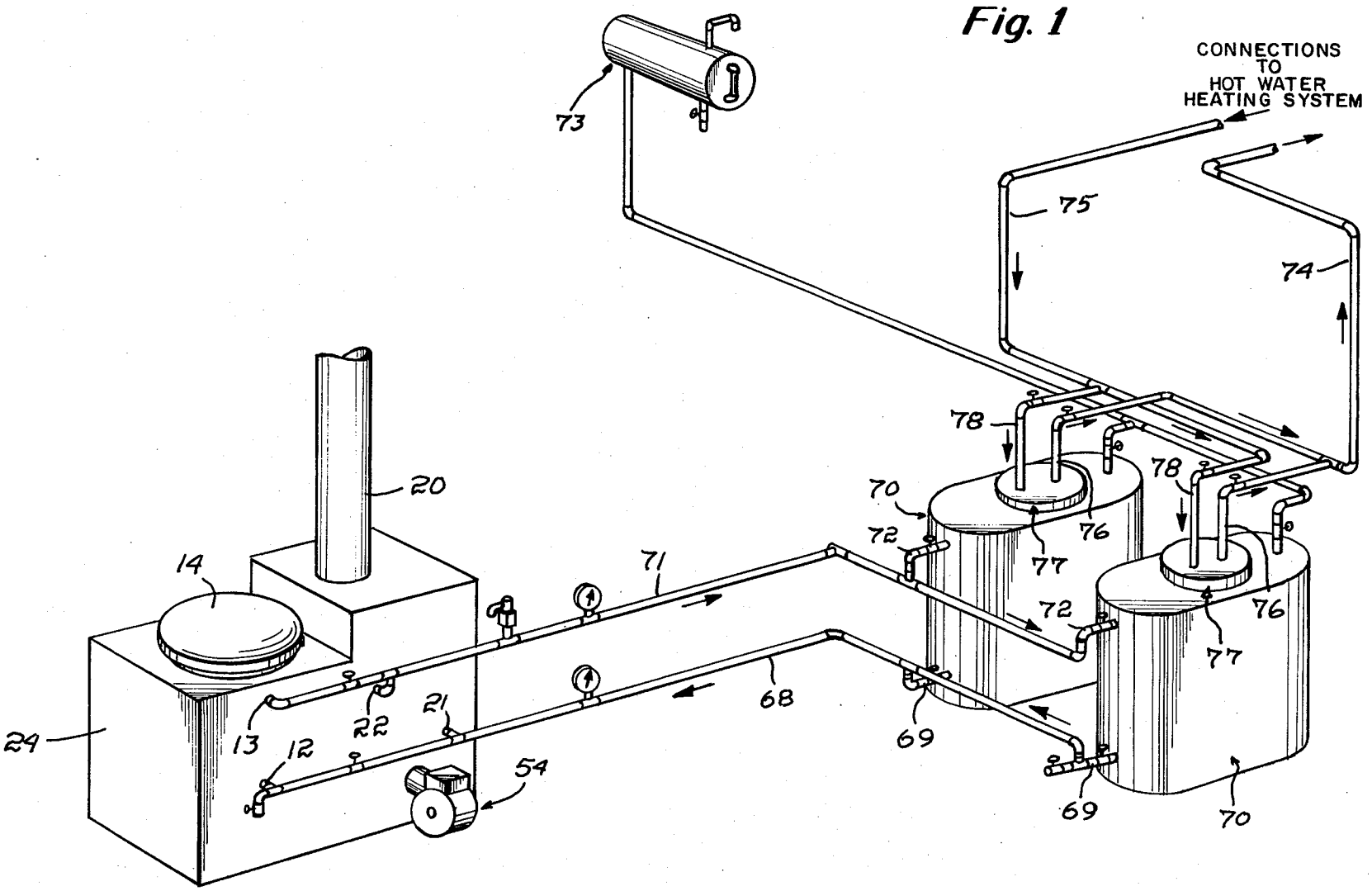
FIG. 1 is a somewhat schematic view of a typical installation in accordance with the invention.
Figure 2:
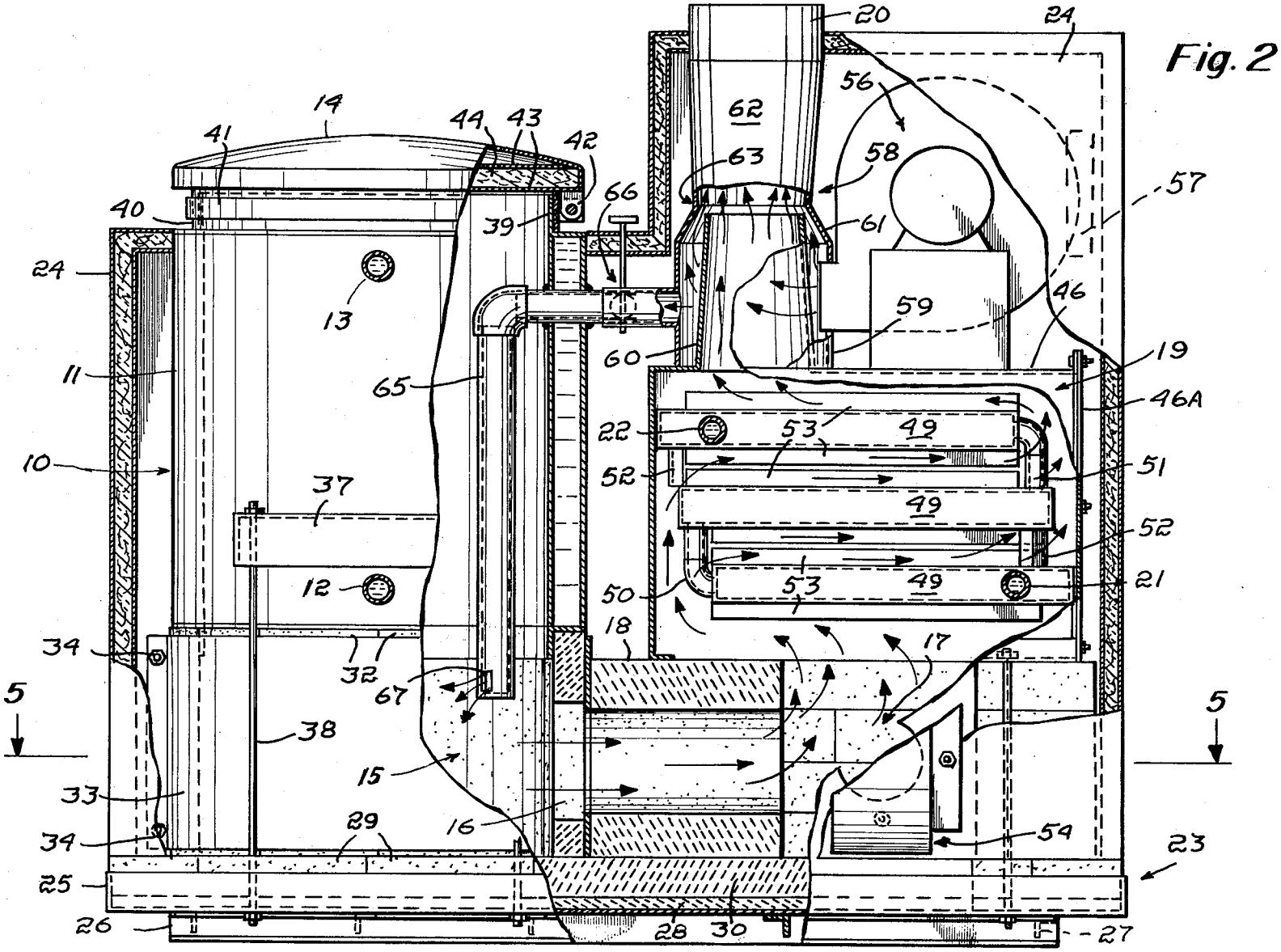
FIG. 2 is a side view of the boiler with the insulated casing broken away.
Figure 3:
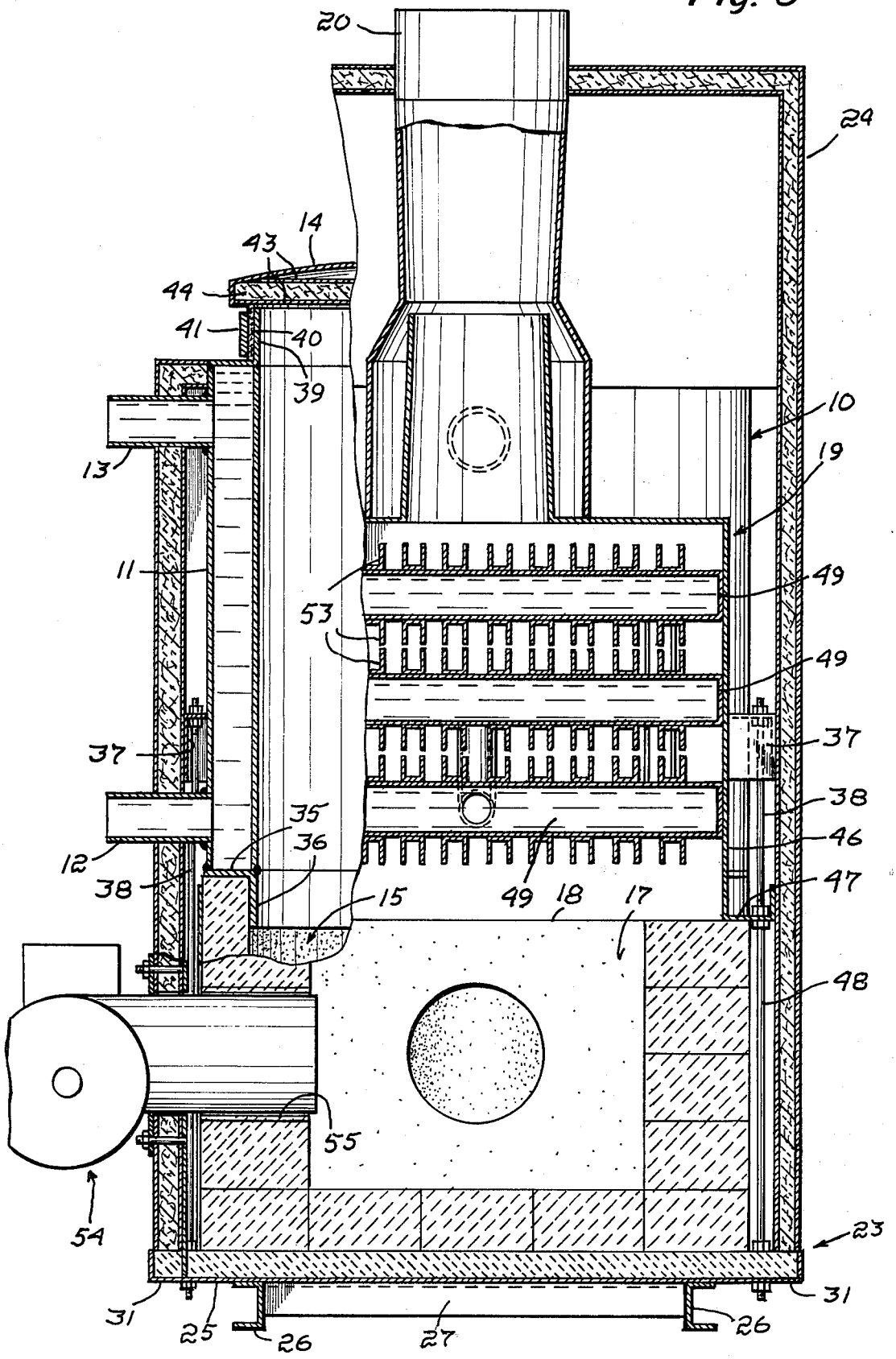
FIG. 3 is a section taken vertically of the boiler through the heat exchanger end thereof and partially broken away to show the water jacketed first chamber.
Figure 4:
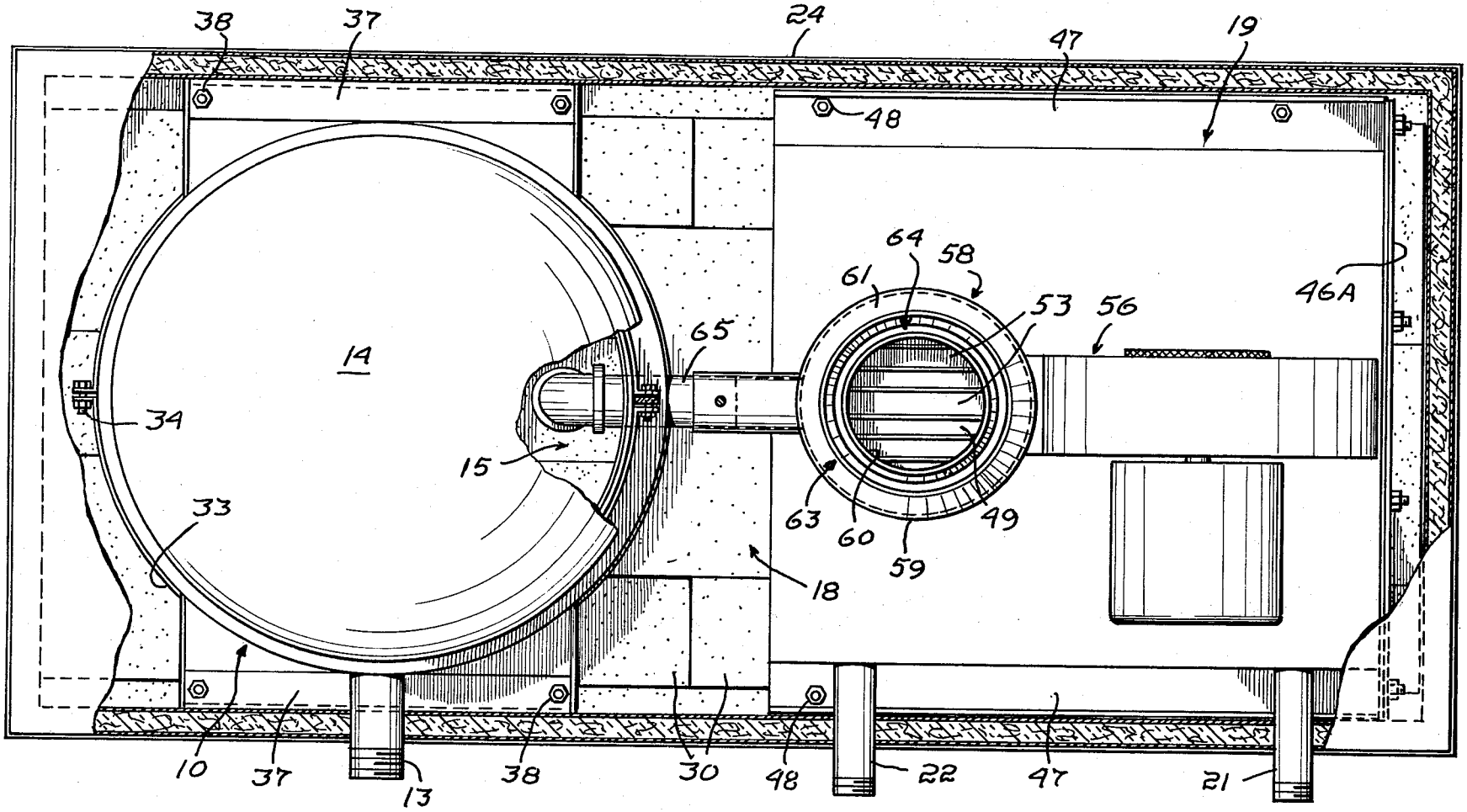
FIG. 4 is a plan view of the boiler with the casing broken away.
Figure 5:
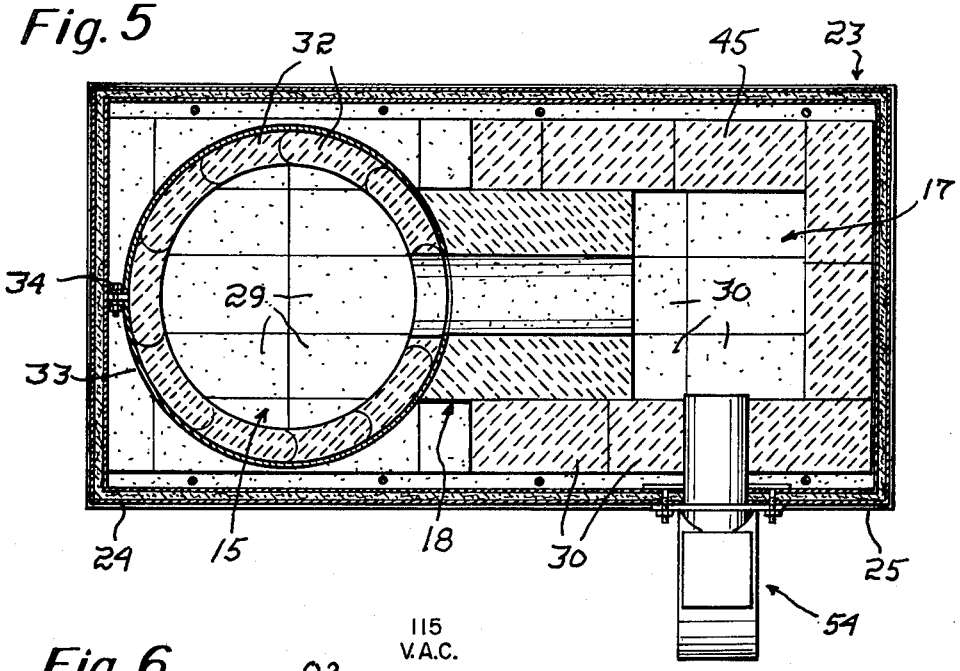
FIG. 5 is a section taken approximately along the indicated line 5—5 of FIG. 2.

Before detailing the boiler of the present invention, as illustrated by the drawings, its components that correspond in general to those of the boiler described and claimed in the related application of Richard C. Hill are briefly described.

A vertical chamber, generally indicated at 10 has, as its upper major portion; a water jacket 11 provided with a lower inlet 12 and an upper outlet 13 with the upper end of the chamber closed by a cover 14. The lower minor portion 15 of the chamber 10 is of refractory material and constitutes the combustion zone. The chamber 10 is circular in cross section and is dimensioned to accommodate a charge of wood as fuel consisting either of a plurality of pieces of stick wood of a length such that with ends resting on the chamber bottom, they extend a substantial distance more or less vertically into the upper portion 11 or a stack of wood the pieces of which are of a length enabling them to fit crosswise in the chamber 10, in either case, the major portion of a charge within the upper portion 11 but free to settle as combustion progresses. The lower chamber portion 15 has a port 16 placed in communication with a second chamber, generally indicated at 17 and of refractory material, by a tunnel 18. The second chamber 17 supports a heat exchanger 19 for the passage therethrough of hot gases to a flue 20. The function of the tunnel 18 is to ensure the substantially complete combustion of wood pyrolysis materials before they reach the heat exchanger 19 which has a water inlet 21 and a water outlet 22. A base, generally indicated at 23, supports the tunnel 18 and provides the bottoms of the two chambers.

Combustion is confined to the chamber portion 15 by virtue of the cooling effect of the water jacket 11 on the fuel in the upper portion and by a turbulent cross draft provided by the discharge of air into the portion 15 above the port 16. Means are also employed to induce the flow of the hot gases through the heat exchanger 19 and to create a slightly subatmospheric pressure in the chambers, tunnel, and the heat exchanger. The means in accordance with the present invention that are operable to create the cross draft and to induce the flow of the hot gases are later detailed.

In accordance with the present invention the chamber 10, the heat exchanger 19 and the tunnel 18 are enclosed by an insulated casing 24 with only the cover 14 and the flue 20 exposed. The generally indicated base 23 has a rectangular metal pan 25 which is supported by lengthwise channel irons 26 and by interconnecting transverse angle irons 27. The pan 25 is covered by a layer of insulation consisting of a series of side-by-side lengths 28, each underlying a plurality of hard fire bricks 29 as the bottom of the chamber 10 and by insulating fire bricks 30 on the remainder of the heat insulating layer. In practice, the sections 28 are one inch thick 1900° F. mineral wool block insulation obtainable from A. P. Green Co. of Mexico, Missouri. The fire bricks are held together by the pan 25 but each is free to move vertically, a feature that is a convenience in forming the base and desirable in the case of the hard bricks 29 as each section 28 is not materially compressed by the several fire bricks it supports but is resiliently compressible if, for example, a heavy piece of wood, dropped into the chamber 10 strikes an individual brick 29 thus cushioning the impact as a safeguard against breakage. The pan 25 has exposed narrow side portions 31.

The chamber 10 is located adjacent one end of the base 23 and its lower portion 15 consists of vertically disposed, molded sections 32 of refractory cement and arcuate in cross section with their side edges so formed that the assembled sections interlock. The sections 32 are held together under compression by a metal band 33 the flanged ends of which are interconnected by tensioning bolts 34. The band 33 is cut away so as not to block the port 16.

The water jacket 11 is welded to a ring 35 resting on the upper end of the chamber portion 17 and provided with a depending flange 36 that is a fit therein. Short horizontal channel iron sections 37 are welded to the water jacket 11, one parallel to each side of the base 23 and overlying the corresponding side portions 31 of the pan 25 to which it is connected by tensioning bolts 38 thus clamping the components of the chamber 17 together to render it substantially air tight.

At the upper end of the water jacket 11 there is an annular rim 39 with an asbestos gasket 40 clamped against it by a metal band 41 to which the cover 14 is hingedly connected as at 42. The cover 14 has metal plates 43 between which 1900° F. insulation 44 is confined with the bottom plate 43 resting on the rim 39 when the chamber 10 is closed, then to provide a suitable seal.

The second chamber 17 is located at the other end of the base 23 and is rectangular in cross section and includes a U-shaped wall section 45 constructed entirely of insulating fire brick 30 with the open end of the section 45 towards the chamber 10 to receive and be closed by an end portion of a tunnel 18 which is of the same height as the wall section 45. The tunnel 18 rests on the base 23 and is molded of an insulating refractory material and cement-sealed to the metal band 33 and to fire brick of the section 45.

The shroud 46 of the heat exchanger 19 is supported by the wall section 45 and by the tunnel 18 remote from their inner edges. The shroud 46 has channels 47 at the bottom of its sides which overlie the side portions 31 of the pan 25 and are connected thereto by tensioning bolts 48. The outer end wall 46A of the shroud is removable to permit cleaning or other servicing of the heat exchanger which is shown as including three vertically spaced flat water compartments 49 the surface area of each of which is substantially greater than the cross sectional area of the interior of the chamber 17.

The lowermost compartment 49 closes the shroud 46 except at the end proximate to the chamber 10 at which end there is a fitting 50 connecting it to the intermediate compartment 49 and has the water inlet 21 at its opposite end. The uppermost compartment 49 closes the shroud except at the end closed by the removable end wall 46A and has the water outlet 22 at its opposite end. The intermediate compartment 49 is spaced from both ends of the shroud and a fitting 51 connects the intermediate and uppermost compartments at their ends proximate to the shroud end wall 49A. Spacers 52, between the intermediate and the other two compartments are located where spacing is not effected by the fittings.

The hot gases flowing through the heat exchanger 19 are thus caused to flow lengthwise across both surfaces of each compartment 49. Both surfaces of each compartment are provided with a closely spaced, series of lengthwise metal channels 53 with the base of each channel in thermal contact with and connected thereto and with its sides constituting heat collecting fins.

As stated, the compartments 49 has a surface area greater than the cross sectional area of the interior of the second chamber 17 which is itself so dimensioned that not only is hot gas entrant thereof spread before entering the heat exchanger but also its dimensions enable a conventional oil burner 54, see FIG. 1, to be used as an alternate heat source. Desirably, the oil burner so employed is one such that the flame from its nozzle will not impinge on the opposite chamber wall. A wall of the chamber section 45 is provided with a normally closed port 55 that may be opened to accommodate the barrel of the oil burner.

As stated earlier, combustion is confined to the lower portion 15 of the chamber 10 by means of a cross draft of air under pressure above the port 16 and by the cooling effect of the water jacket 11 on the charge of wood. In accordance with the present invention, a pressure blower 56 is mounted on the shroud 46. The casing 24 has a louvered port 57 disposed so that entering air is drawn over the motor of the blower. The flue 20 includes a venturi section, generally indicated at 58.

The venturi section 58 has a cylindrical pressure chamber 59 fastened to the shroud 46 and receiving within it the short tapered flue section 60 which is the outlet of the heat exchanger 19. The upper end 61 of the chamber 59 is shown as sharply tapered and is joined to the smaller end of an expansion chamber 62 which tapers gradually upwardly and outwardly to the diameter of the flue 20 to which it is connected. The junction of the chambers 59 and 62 establishes a throat 63 and the upper end of the flue section 60 is at or close to but slightly below the throat and defines therewith an annular orifice 64.

The pressure blower 56 discharges air under pressure into the chamber 59 at one side and diametrically opposite thereto there is a conduit 65 provided with a damper 66. The conduit 65 extends through the water jacket 11 and into the upper portion of the chamber 10 and then downwardly into the lower chamber portion 20 and there provided with two jet ports 67 in the form of vertical slots and spaced 120° apart thereby to cause a turbulent cross draft. The damper 66 is manually adjustable between open and closed positions.

The inside diameter of the throat is six inches and the outside diameter of the flue section 60 is five inches. The ports 67 are each three-quarters of an inch in width and one and one-quarter inch in length.

In the operation of the boiler with a charge ignited and with the blower 56 in service and providing an air stream in the order of 300 CFM, air is not only discharged through the orifice 64 to induce the flow of hot gases through the heat exchanger 19 but is also forced through the conduit 65 to create the wanted turbulent cross draft in the combustion zone. This result is due to the relationship between the dimensions of the orifice 64 and the jet ports 67 which relationship establishes an air stream for the cross draft of about 60 CFM and at an above atmospheric static pressure in the order of three inches.

The conduit 65 is of a diameter, two inches in the disclosed embodiment, to enable the air stream to have a velocity in the order of 1500–2000 feet per minute.

At the same time, the induced flow creates a subatmospheric pressure from the chamber 10 through the heat exchanger 19, the subatmospheric pressure typically less than one inch.

By way of example, the chamber 10 may be about thirty-six inches in height with its inside diameter eighteen inches. A thus dimensioned chamber accommodates a charge of wood in the fifty to seventy-five pound range and in the case of hard woods the moisture content of which is in the approximate range of 10%–25% such a charge will burn for about two and one-half hours with a BTU output in the neighborhood of 140,000 BTU per hour. The average temperature of the water jacket is normally less than 200° F. while the temperature of the gases entering the second chamber 22 is 1800° F. The casing 24 is spaced from the chambers 10 and 17, the tunnel and the heat exchanger to provide a closed air space minimizing heat loss since the air surrounding the lower portion 15 of the chamber 10 rises to envelop the outer surface of the water jacket 11.

Because the chamber 17 is dimensioned to ensure the spreading of the entering gas stream before their entry into the heat exchanger 19, a temperature drop occurs therein with the temperature adjacent the wall opposite the tunnel 18 in the approximate range of from 800° to 900° F. The temperature in the heat exchanger between the middle and upper compartments 49 is typically 600° F. and the temperature of the gas exiting from the heat exchanger is reduced to about 230° F. The temperature of the air-gas mixture entering the flue 20 is typically in the order of 150° F.

The fuel charge may be added to at any time by turning the damper 66 into its closed position before lifting the cover 14, the induced air flow limiting the escape of smoke.

Turning now to FIG. 1, it will be seen that in a typical installation, the water inlets of the water jacket 11 and the heat exchanger 19 are connected to a cold water line 68 having valve controlled connections 69 with each of two insulated storage tanks 70 and the water outlets of the water jacket and the heat exchanger connected to a warm hot water return line 71 having valve controlled connections 72 with the tanks 70, the piping arranged to provide flow by convection. Both tanks are conventionally connected to a vented overflow tank 73.

The heating system of FIG. 1 utilizes a second liquid distributed by delivery and return lines 74 and 75, respectively, the line 74 has valve controlled connections 76 with the appropriate heat exchanger 77 of each tank 70 and the line 75 has valve controlled connections 78 with the return side of each heat exchanger 77.

Figure 6:
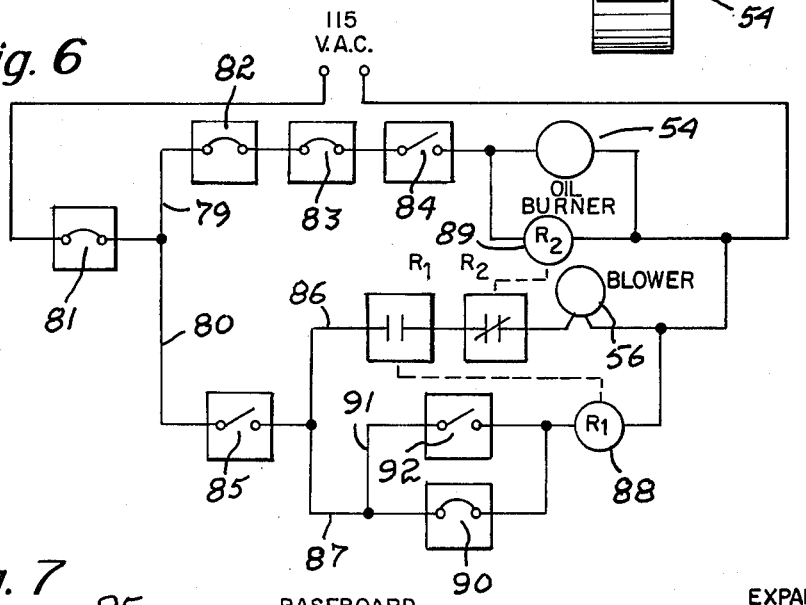
FIG. 6 is a schematic view of the circuitry.

Reference is now made to FIG. 6 wherein control circuitry for the boiler is schematically illustrated.

Both the lead 79 to the oil burner 54 and the lead 80 to the blower 56 are under the control of a switch 81 which opens when the storage water temperature reaches a predetermined high.

The lead 79 has, in series, a switch 82 which closes when the storage temperature falls to a predetermined extent from the wanted maximum storage temperature, a normally closed "Fireomatic" switch 83, and a manually operated switch 84 by which the oil burner 54 may be placed in or out of service.

The lead 80 includes a switch 85 enabling the blower 56 to be placed in or out of service, parallel leads 86 and 87 with the lead 87 having a relay 88 operable, when energized, to close the blower lead 86 unless the relay 89 is energized as it is when the oil burner 54 is in service. The lead 87 has a thermostatically controlled switch 90 which opens when the stack temperature reaches a predetermined minimum indicative of a need for additional fuel and a branch lead 91 includes a time delay switch 92 opening after an interval appropriate for the heating up of the thermostatically controlled switch 90. As a consequence, the blower 56 cannot be brought into service when the oil burner 54 is in use.

Figure 7:
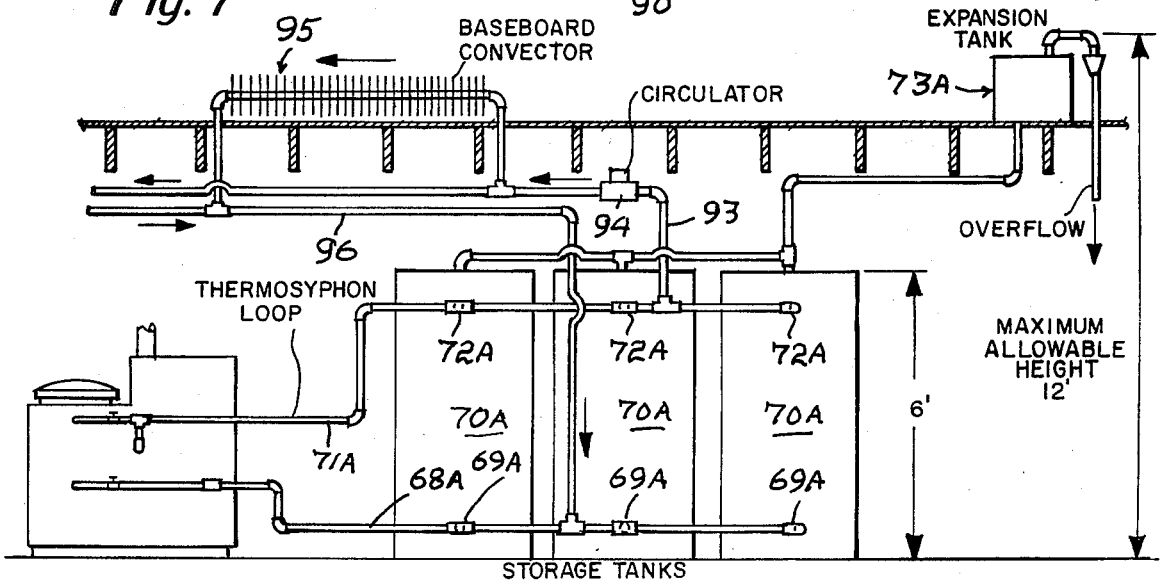
FIG. 7 is a somewhat schematic view of a typical installation in accordance with another embodiment of the invention.

FIG. 7 illustrates schematically an open hot water circulating system utilizing a boiler in accordance with the invention such as the one previously detailed. Sections of the piping that correspond to the system illustrated by FIG. 1 are identified by the same reference numerals distinguished by the suffix addition A.

Each of the three hot water storage tanks 70A has valve controlled connections 72A with the hot water line 71A from the boiler and the hot water line 71A is connected to a conduit 93 provided with a circulator 94 by which hot water is distributed for heating purposes as to the baseboard convector 95. The return line 96 is connected to the cold water line 68A.

Figure 8:
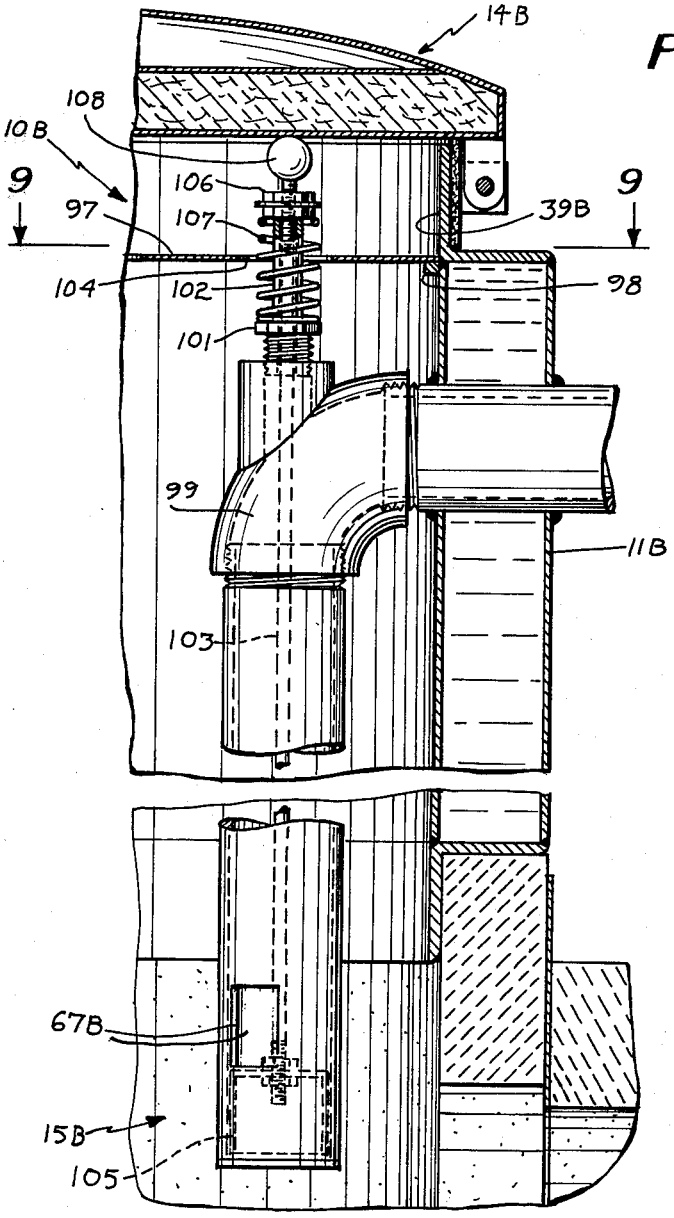
FIG. 8 is a fragmentary section taken vertically through a first chamber having a valve or damper in control of the cross draft jet ports operated by opening and closing of the chamber.
Figure 9:
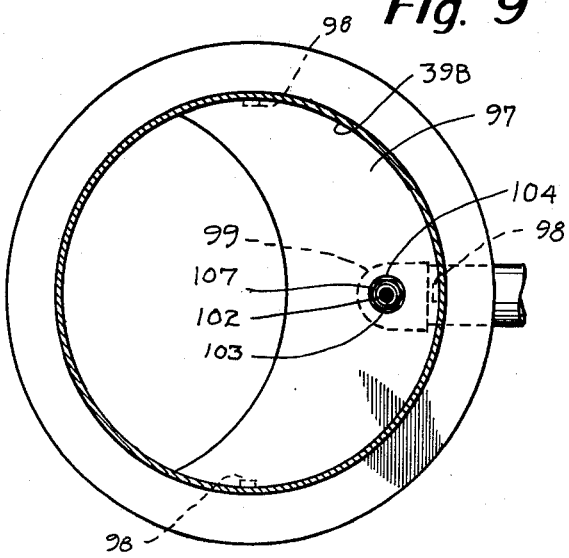
FIG. 9 is a section taken approximately along the indicated line 9—9 of FIG. 8.

In the embodiment of the invention illustrated by FIGS. 8 and 9, only a first chamber is shown and parts thereof that correspond to those of the chamber 10 are not again detailed and are distinguished by the suffix addition B added to the appropriate reference numerals.

In this embodiment of the invention a shelf 97, shown as in the shape of a quarter moon, is supported by tabs 98 welded to the interior of the water jacket 11B of the chamber 10B adjacent the rim 39B. The shelf 97 leaves adequate space for the introduction of fuel and, when the cover 14B is raised with the discharge of air through the jet ports 67 terminated but with the flow of hot gases still induced from the combustion zone 15B, the area of the fuel-receiving opening is so reduced that the velocity of the air flowing into the chamber is increased to reduce the likelihood of smoke escaping therefrom.

In order to prevent the opening of the chamber 10B without stopping the turbulent cross draft in the combustion zone 15B, the elbow 99 joining the horizontal and vertical sections of the air conduit 65B is of a type having a port 100 in vertical alignment with said vertical section. A bushing 101 threaded in the port 100 supports a vertical, axial tubular guide 102 through which one end of a rod 103 slidably extends and which extends freely through a shelf port 104.

The jet ports 67B are spaced above the closed end of the vertical section of the conduit 65B a distance such as to accommodate a damper 105 below them. The damper of shut off 105 is shown as a downwardly opening cup that is a sliding fit in the conduit 65B and of an axial extent enough greater than the vertical extent of the ports 67B so that when lifted to a predetermined extent, the ports 67B are blocked. The closed end of the damper 105 is fastened axially to the other or bottom end of the rod 103. Adjacent its upper end, the rod 103 is provided with a stop 106 between which and the bushing 101 a compression spring 107 surrounding the guide 102 is confined, the shelf port 104 dimensioned freely to accommodate the spring 107. A ball shaped contact 108 is fixed on the upper end of the rod 103. When the spring 107 is untensioned, as it is when the cover 14B is raised to open the chamber 10B, the damper 105 is raised thereby into its operative position blocking the ports 67B and the contact 108 elevated to a corresponding extent with the spring 107 again compressed and the ports 67B unblocked by the re-seating of the cover 14B.

Figure 10:
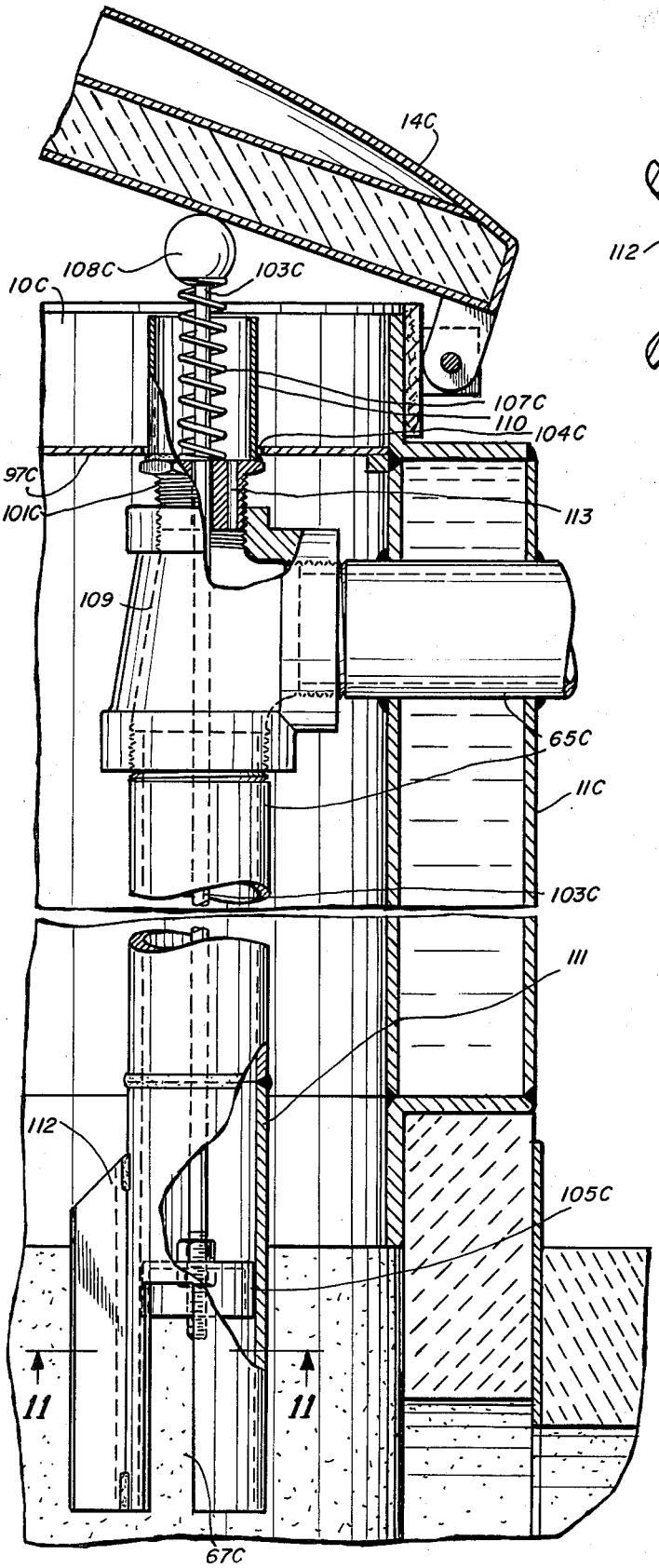
FIG. 10 is a view generally similar to FIG. 8 but showing a heat shield protecting the spring by which the valve is raised into its operative position with cooling air introduced therein.
Figure 11:
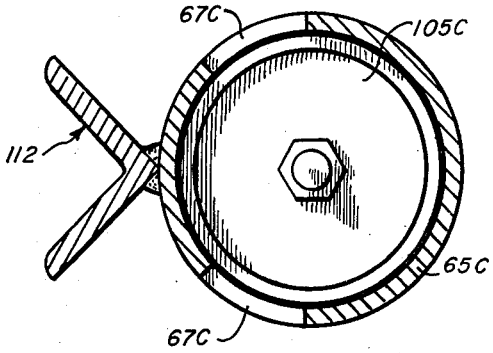
FIG. 11 is a section taken approximately along the indicated line 11—11 of FIG. 10.

Because of the cost of springs that are capable of withstanding the high temperatures that prevail in the upper part 10B, the structure illustrated by FIGS. 10 and 11 is preferred and in the description thereof, corresponding parts are identified by the appropriate reference numeral distinguished by the suffix addition C.

A standard tee 109 is used in place of the elbow 99 and the horizontal and vertical sections of the air conduit 65C are interconnected thereby. The bushing 101C threaded into the upwardly opening end of the tee 109, has a heat shield 110 welded thereto which extends upwardly through the port 104C in the shelf 97C. The bushing 101C slidably supports the rod 103C on the upper end of which a ball shaped contact 108C is fixed. The rod 103C extends downwardly through the vertical section of the conduit 65C and into a stainless steel extension 111 welded to the lower end thereof and provided with the jet ports 67C. A V-shaped reinforcement 112 has its apex welded to the extension 111 between the ports 67C to hold wood away therefrom.

A spring 107C within the heat shield 110 is confined between the contact 108C and the bushing 101C and is held compressed, when the cover 14C is closed, with the rod 103C then being forced downwardly to an extent such that the damper of valve 105C is below the ports 67C. When the cover is raised, the spring 107C lifts the rod 103C to an extent such that the ports 67C are blocked by the valve 105C.

The bushing 101C has a drilled port 113, in practice in the order of 3/16 inch, effecting communication between the interior of the tee 109 and the interior of the heat shield thus providing a forced flow of relatively cool air that is adequate to prevent an ordinary compression spring from being subjected to damaging temperatures.

We claim:

1. A boiler for use with a charge of wood as fuel, said boiler including a first chamber that is normally closed and substantially air tight and has a bottom portion that is a combustion zone and an upper portion that is a water jacket, said chamber dimensioned to accommodate a charge of wood consisting either of pieces of wood of a length such that with ends resting on the chamber bottom, the pieces extend more or less vertically into the upper chamber portion or a stack of shorter sections that may lay crosswise of the chamber, in either case the major portion of the charge in the upper portion and free to settle as combustion progresses, a second chamber in communication with the combustion zone, a heat exchanger positioned relative to the second chamber to receive hot gases therefrom and provided with a flue section for exiting gases and a venturi section including a pressure chamber, portions of said flue section and said pressure chamber establishing an orifice such that air discharged through the orifice will induce the flow of hot gas from the combustion chamber through the heat exchanger, a conduit effecting communication between said pressure chamber and the bottom portion of the first chamber and there provided with at least one jet port disposed to create a cross draft therein, and a pressure blower in communication with the pressure chamber and operable to deliver thereto a stream of air under pressure at a wanted CFM rate, the area of said orifice and the area of said jet port so related that a predetermined minor portion of the air stream is forced into said conduit and through said jet port at a wanted velocity and static pressure such that the cross draft is turbulent, said turbulent cross draft and the cooling effect of said jacket on the charge of fuel effective to confine the burning of the charge to the combustion zone, the remainder of the air stream from said blower discharged from said pressure chamber through said orifice to induce said hot gas flow through the heat exchanger.

2. The boiler of claim 1 in which the conduit includes a shut off operable to block the flow of air therethrough and terminate the cross draft.

3. The boiler of claim 2 in which the pressure chamber is cylindrical and includes an inwardly tapering open end and the venturi also includes an expansion chamber joined at one end to said end and tapering outwardly towards its other end with the proximate portions of the venturi chambers establishing a throat, the flue section of the heat exchanger extends concentrically into said pressure chamber with its free end approximately at the throat and defining therewith an annular orifice, the pressure blower discharges air into the pressure chamber through the side thereof and the conduit opens into the pressure chamber diametrically opposite to the blower.

4. The boiler of claim 1 in which the conduit has two jet ports spaced 120° apart.

5. The boiler of claim 4 in which each jet port is a vertical slot.

6. The boiler of claim 1 and an oil burner, the barrel of which is entrant of said second chamber, and means to prevent automatically the operation of said pressure blower when the oil burner is in use.

7. The boiler of claim 2 in which the first chamber includes a cover, the conduit includes a first portion extending from the pressure chamber into the upper end of the first chamber and a second portion extending vertically downwardly therefrom into the lower portion thereof and a junction between said portions, a rod extending slidably through said junction with said shut off a valve connected to the lower end thereof, means resiliently urging said rod upwardly, said rod of a length such that when the cover is closed, the upper end thereof is engaged and the rod depressed thereby to place said valve below said port, said resilient means so lifting said rod, when the cover is raised, as to place said valve in a position blocking air flow through said port.

8. The boiler of claim 7 in which the means urging the rod upwardly includes a compression spring held compressed when the cover is closed and untensioned when the valve is raised to block the jet port.

9. The boiler of claim 8 and a shelf adjacent the upper end of the first chamber and having a port dimensioned to accommodate the spring and rod, the shelf dimensioned to so restrict the area of the upper end of the chamber when the cover is opened that the flow of air downwardly therein because of the induced flow of hot gases from the combustion zone is so increased as to minimize the likelihood of smoke escaping upwardly.

10. The boiler of claim 7 in which the resilient means is a compression spring confined between the junction and the upper end of the rod, a heat shield supported by said junction protects said spring, and means are provided to bleed air from said conduit into said heat shield.

11. The boiler of claim 10 in which the junction is a tee, a bushing closes the upper port and has a bore through which the rod extends.

12. The boiler of claim 11 in which the heat shield is a sleeve secured to said bushing and the air bleeding means is a drilled bore through said bushing and opening into said sleeve.

13. The boiler of claim 9 in which the resilient means is a compression spring confined between said junctions and the upper end of the rod, a heat shield connected to said junction surrounds said spring and extends through said port, and an air bleeding passage in said junction effects communication between the interior thereof and the interior of said shield.

14. A boiler for use with a charge of wood as fuel, said boiler including a first chamber that is normally closed and substantially air tight and has a bottom portion that is a combustion zone and an upper portion that is a water jacket, said chamber dimensioned to accommodate a charge of wood consisting either of pieces of wood of a length such that with ends resting on the chamber bottom, the pieces extend more or less vertically into the upper chamber portion or a stack of shorter sections that may lay crosswise of the chamber, in either case the major portion of the charge in the upper portion free to settle as combustion progresses, a second chamber in communication with the combustion zone, a heat exchanger positioned relative to the second chamber to receive hot gases therefrom and provided with a flue for exiting gases, and means to create a turbulent cross draft in the lower portion of the first chamber, the cross draft and the cooling effect of the water jacket on the fuel charge confining the burning of the charge to the combustion zone, and to induce flow of the hot gases from the combustion zone through the heat exchanger, said means including an electrically operated blower, said second chamber including an oil burner as an alternate heat source, the oil burner of the type having an electric motor and control means to prevent the operation of the blower when said oil burner is in service, said control means including circuitry having a first lead provided with a manually operated switch, a second lead in parallel with the first named lead and including the oil burner motor, a manually operated switch, and a relay energized when the second lead is energized then to hold open the first named lead.

15. A boiler for use with a charge of wood as fuel and including a base provided with a fire brick layer, a first chamber that is normally closed and substantially air tight and has a lower portion resting on said fire brick and establishing therewith a combustion zone, an upper portion that is a water jacket, an intermediate flat ring resting on the upper end of the lower chamber portion, said upper portion including a depending flange that is a fit inside the upper end of the lower portion, and means connecting said upper portion to said base and clamping said portions against said ring and said lower portion against said base to provide leakproof joints, said chamber dimensioned to accommodate a charge of wood consisting of pieces of wood of a length such that with the ends resting on the fire brick, the pieces extending more or less vertically into the upper chamber portion or a stack of shorter sections that may lay crosswise of the chamber, in either case the major portion of the charge in the upper portion and the charge free to settle as combustion progresses, a second chamber in communication with the combustion zone, a heat exchanger supported by the second chamber to receive hot gases therefrom and provided with a flue for exciting gases, means to induce the flow of hot gases through the heat exchanger, and means to deliver air into the lower portion of the first chamber as a turbulent cross draft, said cross draft and the cooling effect of said water jacket functioning to confine the burning of the charge to said combustion zone.

16. The boiler of claim 14 in which the circuitry includes a second relay operable when energized to close said first lead, and the first lead includes a pair of parallel leads both controlled by the mutually operated switch of the first lead and both including the second relay, one of said pair of leads provided with a thermally responsive switch closed when a predetermined operating temperature is reached and the other including a switch which is normally open but closes when said predetermined temperature exists.

17. The boiler of claim 4, and a V-shaped reinforcement the apex of which is welded vertically to the conduit between the two jet ports thereby to hold wood away therefrom.

* * * * *